US009458724B2

(12) United States Patent
Tetkoskie

(10) Patent No.: US 9,458,724 B2
(45) Date of Patent: Oct. 4, 2016

(54) MOLTEN METAL IMPELLER

(71) Applicant: Jason Tetkoskie, Cleveland Heights, OH (US)

(72) Inventor: Jason Tetkoskie, Cleveland Heights, OH (US)

(73) Assignee: PYROTEK, INC., Spokane, WA (US)

( * ) Notice: Subject to any disclaimer, the term of this patent is extended or adjusted under 35 U.S.C. 154(b) by 811 days.

(21) Appl. No.: 13/772,711

(22) Filed: Feb. 21, 2013

(65) Prior Publication Data

US 2013/0224038 A1 Aug. 29, 2013

Related U.S. Application Data

(63) Continuation-in-part of application No. 13/176,254, filed on Jul. 5, 2011, now Pat. No. 8,899,932.

(60) Provisional application No. 61/361,075, filed on Jul. 2, 2010.

(51) Int. Cl.

| | |
|---|---|
| ***F04D 7/06*** | (2006.01) |
| ***F01D 5/14*** | (2006.01) |
| ***F04D 29/22*** | (2006.01) |

(52) U.S. Cl.

CPC ..... *F01D 5/147* (2013.01); *F04D 7/065* (2013.01); *F04D 29/22* (2013.01)

(58) Field of Classification Search

CPC ..... F04D 7/00; F04D 7/02; F04D 7/06; F04D 7/065; F04D 29/2222

USPC ..... 416/223 B, 212 R

See application file for complete search history.

(56) References Cited

U.S. PATENT DOCUMENTS

| | | | | |
|---|---|---|---|---|
| 5,470,201 | A | 11/1995 | Gilbert et al. | |
| 5,785,494 | A | 7/1998 | Vild et al. | |
| 7,144,217 | B2 | 12/2006 | Gilbert et al. | |
| 7,326,028 | B2 * | 2/2008 | Morando | F04D 7/065 415/102 |
| 9,131,814 | B2 * | 9/2015 | Nakamura | A47L 5/22 |
| 2005/0013713 | A1 | 1/2005 | Cooper | |

FOREIGN PATENT DOCUMENTS

| | | |
|---|---|---|
| JP | 06-050281 | 2/1994 |
| WO | WO 2009-143569 | 12/2009 |

OTHER PUBLICATIONS

International Search Report from PCT/US2011/042944.

* cited by examiner

*Primary Examiner* — Richard Edgar

(74) *Attorney, Agent, or Firm* — Fay Sharpe LLP

(57) ABSTRACT

According to another embodiment, a molten metal impeller comprised of a generally cylindrical body including a plurality of passages extending from a top surface to a side wall and a cap member secured to a top surface of the body. The cap member is shaped cooperatively to overlay the cylindrical body. The cap member includes a first side seated on the top surface and a second opposed side. The top surface includes one of a notch or a protrusion and the first side of the cap member includes one of a notch or a protrusion oriented to mate with the notch or protrusion of the body.

18 Claims, 8 Drawing Sheets

MOLTEN METAL IMPELLER

The present application is a continuation-in-part filing based on U.S. Ser. No. 13/176,254 filed Jul. 5, 2011, which claims priority to U.S. Provisional Patent Application No. 61/361,075 filed on Jul. 2, 2010, which are incorporated herein by reference.

BACKGROUND

The present disclosure is directed to a molten metal impeller having improved metal flow properties. According to one embodiment, a protective flow inducing cap member for a molten metal pump impeller is provided.

This disclosure generally relates to molten metal pumps. More particularly, this disclosure relates to an impeller suited for use in a molten metal pump. The impeller is particularly well suited to be used in molten aluminum pumps. However, it should be realized that the impeller can be used in any pump employed in refining or casting molten metals.

In the processing of molten metals, it is often necessary to move molten metal from one place to another. When it is desired to remove molten metal from a vessel, a so called transfer pump is used. When it is desired to circulate molten metal within a vessel, a so called circulation pump is used. When it is desired to purify molten metal disposed within a vessel, a so called gas injection pump is used. In each of these types of pumps, a rotatable impeller is disposed within a pumping chamber in a vessel containing the molten metal. Rotation of the impeller within the pumping chamber draws in molten metal and expels it in a direction governed by the design of the pumping chamber.

In each of the above referenced pumps, the pumping chamber is formed in a base member which is suspended within the molten metal by support posts or other means. The impeller is supported for rotation in the base member by means of a rotatable shaft connected to a drive motor located atop a platform which is also supported by the posts.

An exemplary pump in which the impeller of this disclosure can operate is depicted in FIG. 1. FIG. 1 depicts the arrangement of the impeller 14 in a molten metal pump 32. Particularly, a motor 34, is secured to a motor mount 36. A riser 38 (indicating this pump to be a transfer-style) through which molten metal is pumped is provided. The riser 38 is attached to the motor mount 36 via a riser socket 40. A pair of refractory posts 42 are secured by a corresponding pair of post sockets 44, a rear support plate 46 and bolts 48 to the motor mount 36. At a second end, each of the posts 42, and the riser 38, are cemented into a base 50. The base 50 includes a pumping chamber 52, in which the impeller 14 is disposed. The pumping chamber is constructed such that the impeller bearing ring 10 is adjacent the base bearing ring 54. The impeller is rotated within the pumping chamber via a shaft 59 secured to the motor by a threaded connection 60 pinned to a universal joint 62.

Obviously, there is a desire to increase the efficiency of a molten metal impeller. Improving the flow of metal into the impeller is one mechanism by which this is achieved. It is a further desire to limit the degradation of the impeller. Moreover, to operate in a high temperature, reactive molten metal environment, a graphite material is typically used to construct the impeller. Graphite is prone to degradation when exposed to particles entrained in the molten metal. More specifically, the molten metal may include pieces of the refractory lining of the molten metal furnace, undesirables from the metal feed stock and occlusions which develop via chemical reaction, all of which can cause damage to an impeller.

BRIEF DESCRIPTION

According to one embodiment, a molten metal impeller is provided. It includes a generally cylindrical graphite body having a plurality of passages extending from a top surface to a side wall. A hub is formed in the center of the graphite body. A ceramic cap member is secured to the top surface of the graphite body. The cap member is comprised of a ring forming a central passage shaped cooperatively to overlap the hub and a plurality of vanes extending radially from the ring to an outer rim. The rim has a height between adjacent vanes which increases in the direction of intended impeller rotation. The rim also has a height which decreases from its radially outer most edge to an inner most edge.

According to a further embodiment, a molten metal impeller comprised of a graphite body having a central hub disposed upon a generally disk shaped base and at least two vanes extending from the hub is provided. A ceramic cap member engages a top surface of the graphite body. The cap member has a central ring sized to overlay the hub and wings extending therefrom. The wings are shaped to cooperatively overlay the vanes. Each wing includes a terminal end with a vane engaging edge and an opposed chamfered edge.

According to a further embodiment, a molten metal impeller comprised of a generally cylindrical graphite body is provided. The graphite body includes a plurality of vanes defining passages extending from a first surface to a side wall. A ceramic cap member is secured to the first surface. The cap member is comprised of a plurality of vanes corresponding to the plurality of graphite body vanes and a rim. The rim includes a plurality of segments between adjacent vanes wherein the segments have a height profile which increases in the direction of intended impeller rotation.

According to an additional embodiment, a molten metal impeller is provided. The impeller is comprised of a graphite body having an at least substantially cylindrical sidewall and opposed top and bottom end walls. At least one of the end walls forms an inlet comprised of multiple passages extending to the sidewall. The passages are defined by a plurality of radially extending vanes and a peripheral rim. The vanes have a terminal portion intersecting the rim. The terminal portions are canted in the intended direction of impeller rotation. In addition, the sections of rim between the vanes include a surface which slopes downward away from the direction of intended impeller rotation.

According to another embodiment, a molten metal impeller comprised of a generally cylindrical body including a plurality of passages extending from a top surface to a side wall is provided. A cap member is secured to a top surface of the body. The cap member is shaped cooperatively to overlay the body. The cap member includes a first side seated on the top surface and a second opposed side. The top surface includes one of a recess or a protrusion and the first side of the cap member includes one of a recess or a protrusion oriented to cooperatively mate with the recess or protrusion of the body.

According to a still further embodiment, an impeller having an intended direction of rotation and comprised of a body having an at least substantially cylindrical base is provided. A hub is disposed on a first side of the base, and a plurality of vanes extend from the base and the hub. The vanes include a free end adjacent a periphery of the impeller and a cap receiving side opposed to the base. The cap receiving side has a receiving surface having a recessed leading edge in the intended direction of rotation and a raised trailing edge. A cap member having a ring sized to overlay the hub and a plurality of fingers extending from the ring and configured to overlay the vanes is secured to the body. The fingers include a raised leading edge mating with the recessed leading edge of the vane and a recessed trailing edge mating with the raised trailing edge of the vane.

According to an additional embodiment, an impeller having an intended direction of rotation and comprised of a body having a base and a plurality of vanes extending from the base is provided. The vanes include a cap receiving side opposed to a side extending from the base. The cap receiving side has a receiving surface including a recessed leading edge in the intended direction of rotation and a raised trailing edge. A cap member having a plurality of fingers configured to overlay the vanes is provided. At least one finger includes a surface having a projection mating with the recessed leading edge of the associated receiving surface and a recessed trailing edge mating with the projecting trailing edge of the associated receiving surface.

A further embodiment is directed to a molten metal pump comprised of a motor, and an associated shaft. The shaft is attached to the impeller described in the preceding paragraphs.

BRIEF DESCRIPTION OF THE DRAWINGS

In accordance with one aspect of the present exemplary embodiment.

DETAILED DESCRIPTION

Figure 1:
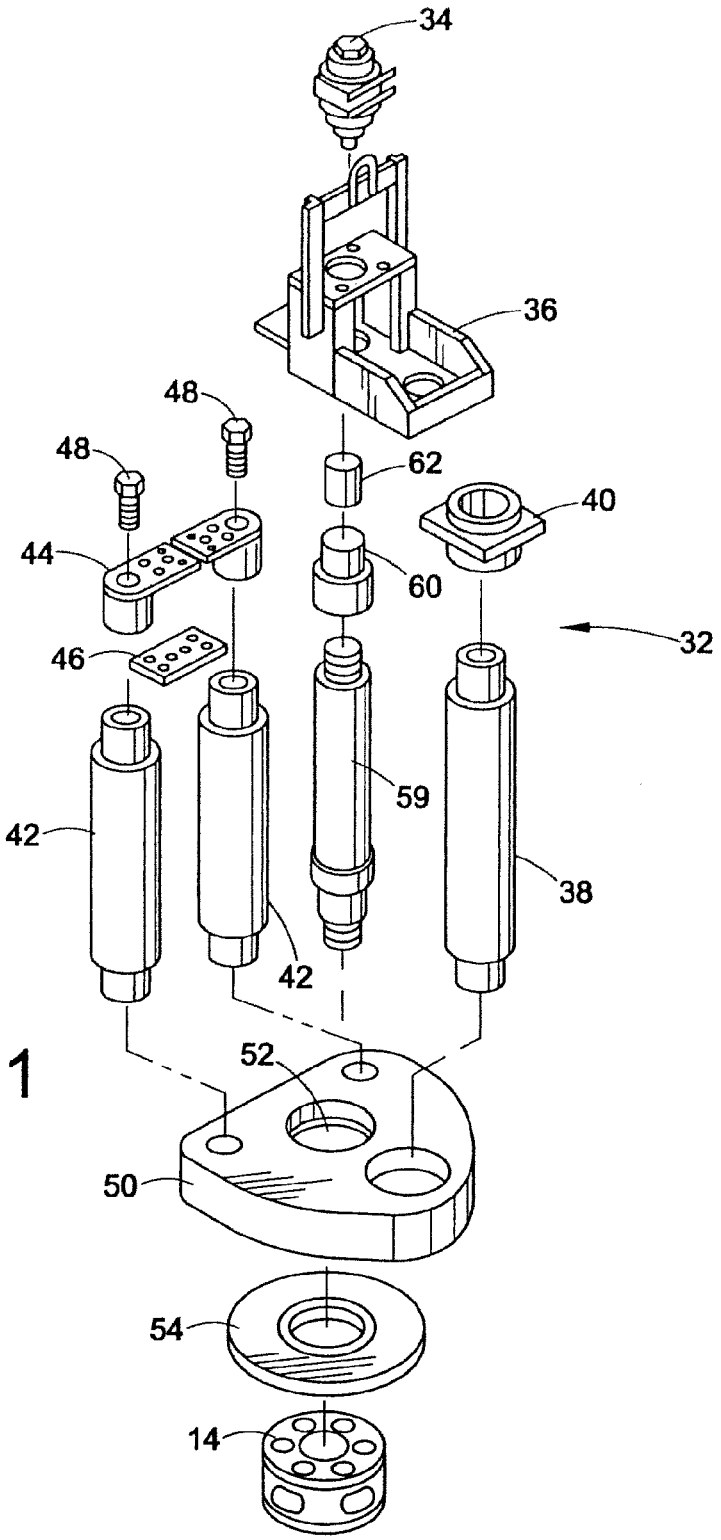
FIG. 1 is a perspective view of a prior art molten metal pump.
Figure 2:
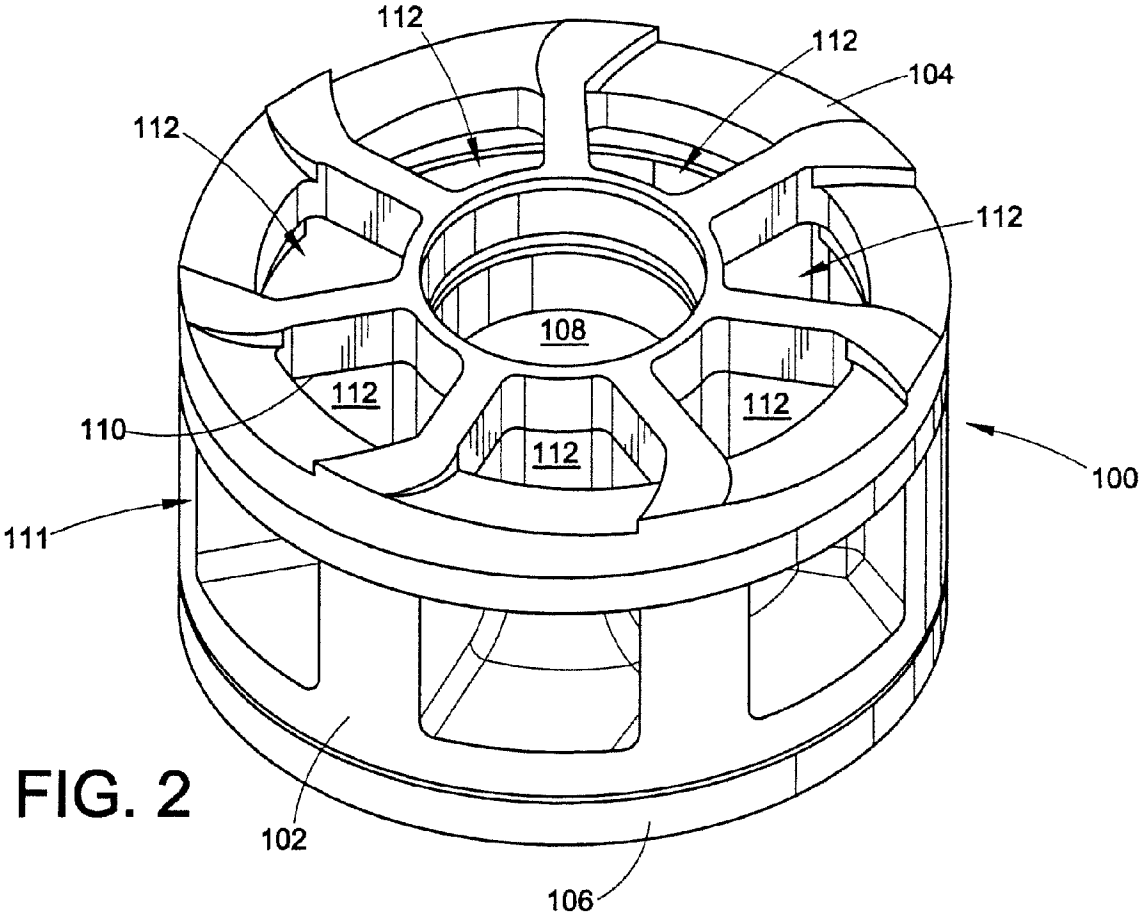
FIG. 2 is an perspective view of the present impeller.

Reference will now be made in detail to the representative embodiments of the invention, examples of which are illustrated in the accompanying drawings. While the invention will be described in connection with the selected embodiments, it will be understood that it is not intended to limit the invention to those embodiment. On the contrary, it is intended to cover all alternatives, modifications and equivalents that may be included within the spirit and scope of the invention defined by the appended claims.

A new and improved impeller for use in molten metal pumps is disclosed. In particular, the impeller is utilized in molten metal pumps to create a forced directional flow of molten zinc or molten aluminum. U.S. Pat. Nos. 2,948,524; 5,078,572, 5,088,893; 5,330,328; 5,308,045, 5,470,201 and 6,464,458 herein incorporated by reference, describe a variety of molten metal pumps and environments in which the present impeller could be used.

Referring now to FIGS. 2-5, impeller 100 is depicted. Impeller 100 includes three main components; a graphite body 102, a top cap 104, and a bearing ring 106. A hub 108 is centrally formed in the graphite body 102 to receive a shaft. Although indicated as cylindrical in shape, the hub and corresponding top cap passage could be formed to have flat surfaces for mating with a cooperatively shaped shaft. It is further envisioned that the present embodiment is functional with an impeller which connects to a shaft via a mechanism other than a hub. For example, a threaded post could extend from the impeller body and be received within a threaded bore of a shaft. The present disclosure contemplates use with the myriad of shaft impeller connections available to the skilled artisan.

Graphite body 102 is generally cylindrically shaped and includes a plurality of passages 112 extending from an upper surface 110 to side wall 111. Four or more passages are typically present. Cap 104 is secured (for example via cement) to upper surface 110. Although reference is made to passages originating in a top surface, it is noted that bottom feed impellers can similarly benefit from the present disclosure. Accordingly, contemplated within this disclosure are impellers having either top or bottom surface passages or both. Similarly, it is envisioned that the cap can be secured to either or both top and bottom surfaces.

Figure 4:
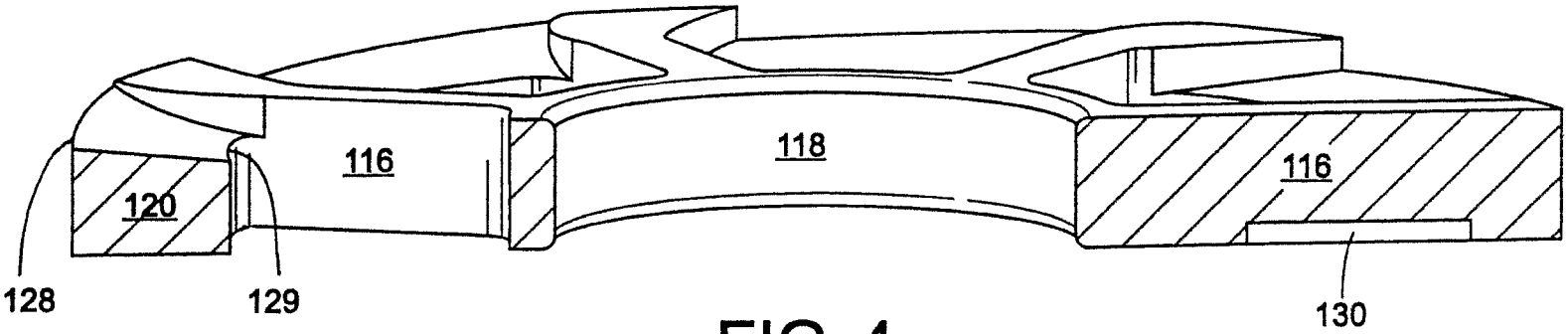
FIG. 4 is a cross-section taken along lines A-A of FIG. 3.

With reference to FIG. 4, the cement joinder of the cap member 104 to the graphite body 102 can be enhanced by including cooperative grooves 130 in the mounting surfaces of each (not shown in the graphite body). Moreover, in this manner a cement channel is formed that extends into the top cap 104 and into the graphite body 102. In addition, in certain environments, it may be desirable to extend a pin between the cap member 104 and the graphite body 102.

Figure 3:
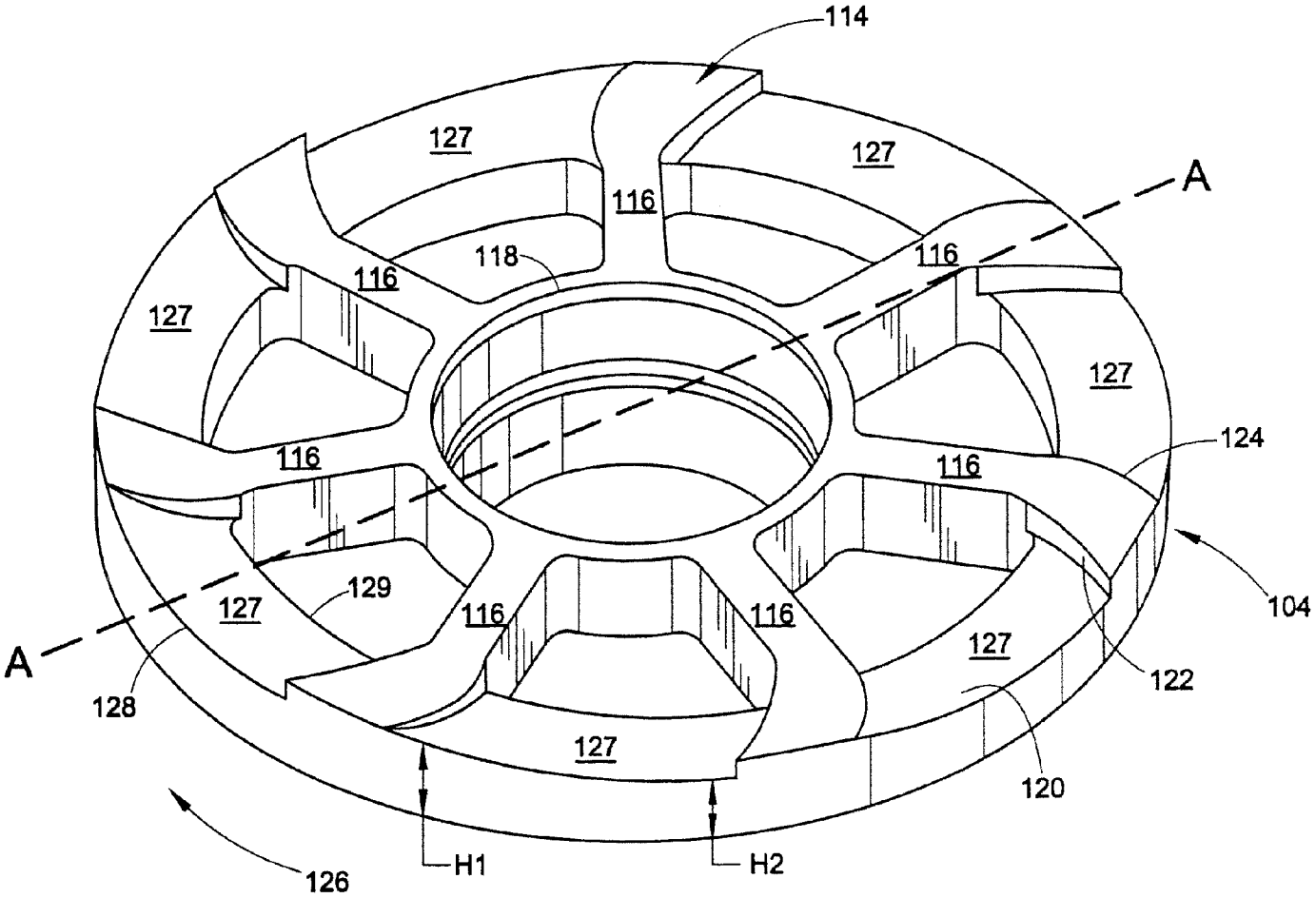
FIG. 3 is a perspective view of the cap member removed from the impeller of FIG. 2.
Figure 5:
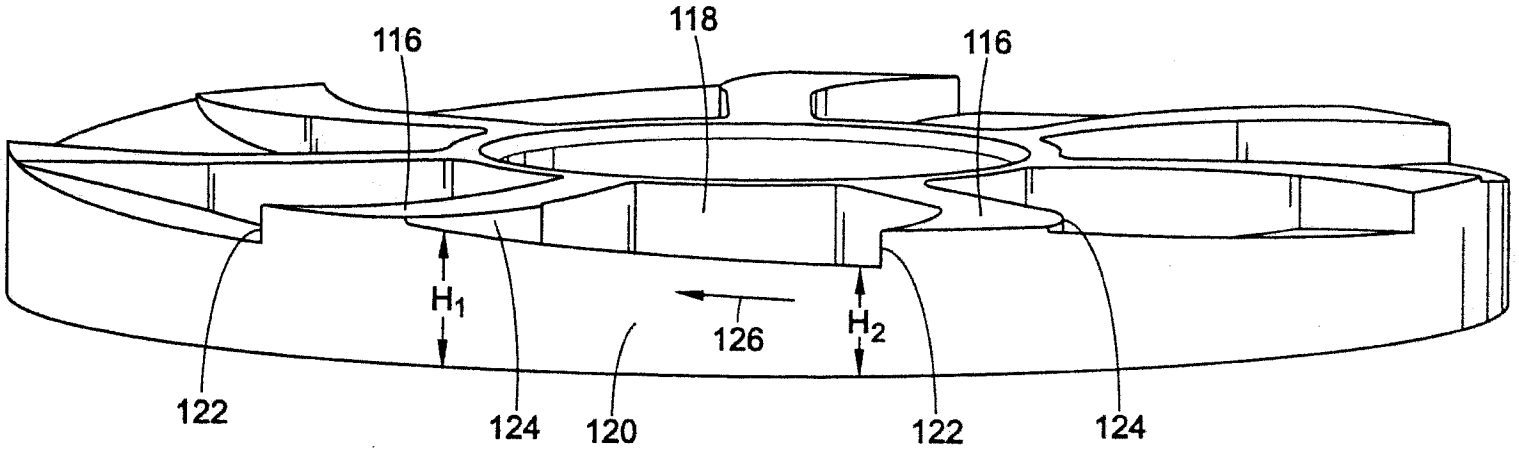
FIG. 5 is a side elevation view of the cap member of FIG. 3.

Cap member 104 can be shaped to generally match the outline shape of graphite body 102. Cap member 104 further has a top surface 114 profile which encourages induction of fluid. Referring now to FIGS. 3 and 5, vanes 116 extend radially from a central ring 118 to an outer rim 120. Rim 120 include segments between adjacent vanes having a height profile which slopes downwardly from H1 to H2 between adjacent vanes 116. H1 is greater than H2 such that the terminal portion of vanes 116 have a higher leading edge 122 than trailing edge 124 to create a scooping action in the direction of intended rotation 126. In certain embodiments, the ratio of H1:H2 is at least 4:3. Furthermore, the leading edge 122 may be forwardly canted (in the direction of intended impeller rotation 126) relative to the portion of vane 116 between central ring 118 and outer rim 120. Trailing edge 124 can also be forwardly canted. In addition, top surface 114 includes a flow inducing surface 127 which slants downwardly from its peripheral edge 128 to its inner edge 129 adjacent passages 112, effectively funneling molten metal therein. Moreover, there is an incline in surface 127 relative to the planar orientation of the cap member 104. In an exemplary embodiment the incline is at least 5 degrees.

Figure 6:
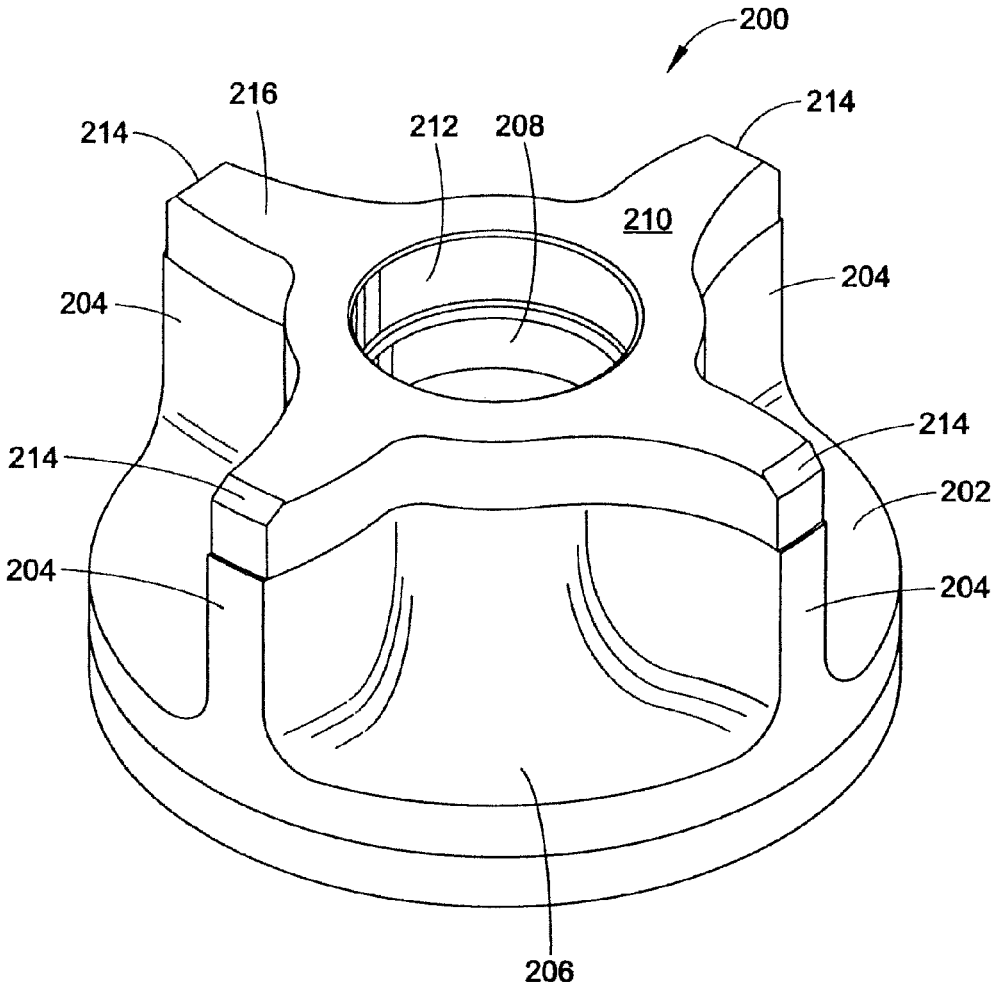
FIG. 6 is a perspective view of an alternative impeller embodiment.

Referring now to FIG. 6, an open top impeller 200 is depicted. In this embodiment, the impeller includes four blades 204 which reside upon a disk shaped base 206 and extend from hub 208. Cap 210 is shaped to mate with and overlay the vanes and includes a passage 212 providing access to hub 208 which accommodates a shaft. The cap member includes chamfered radial edges 214, provided to facilitate the placement of the impeller within the pump housing. Moreover, referring again to FIG. 1, during installation, the impeller is typically installed via insertion through the lower opening of the pump housing. Given the hardness of the material forming the cap member, sharp edges thereon at the radial surface would increase the likelihood of chipping and/or otherwise damaging the pump housing during the installation step. The chamfer allows proper registration of the impeller within the pump housing without causing chipping damage. A preferred chamfer forms an angle relative to the planar surface 216 of the cap member of between about 20 and 60° or about 30 and 50°.

Figure 7:
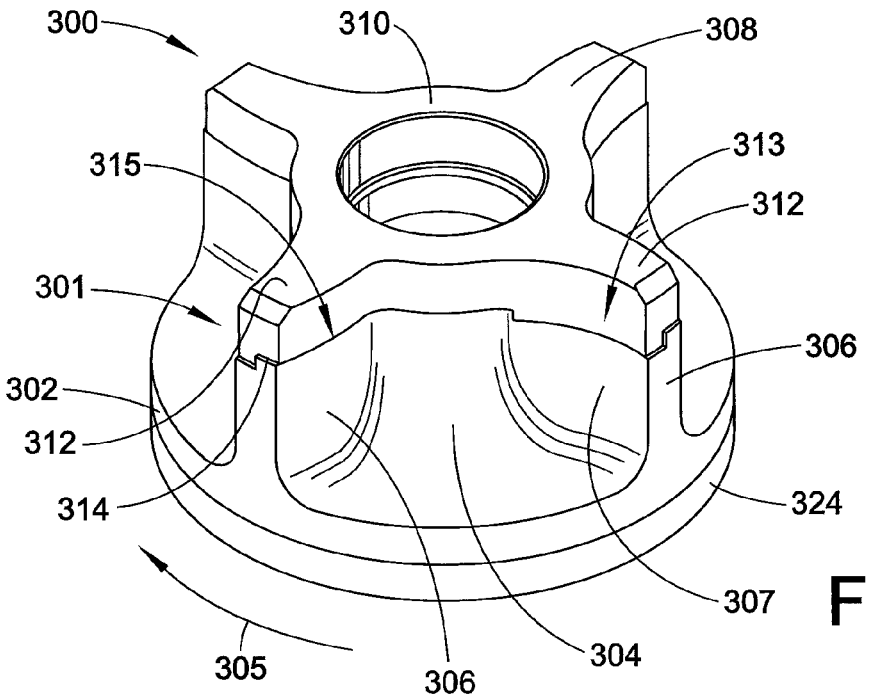
FIG. 7 is a perspective view of an alternative impeller embodiment.
Figure 9:
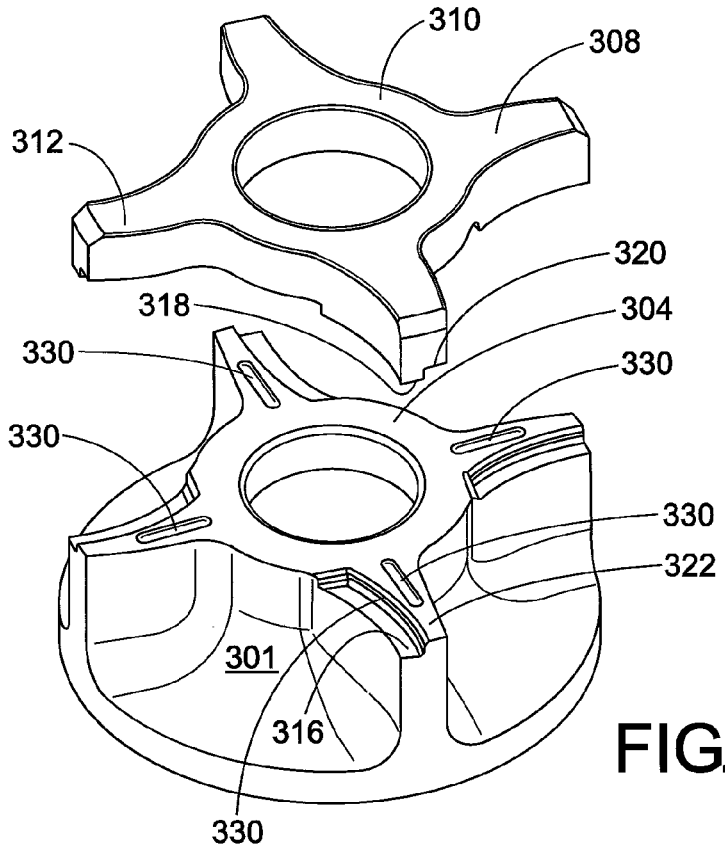
FIG. 9 is an exploded view of the impeller of FIG. 7 (without bearing ring).
Figure 8:
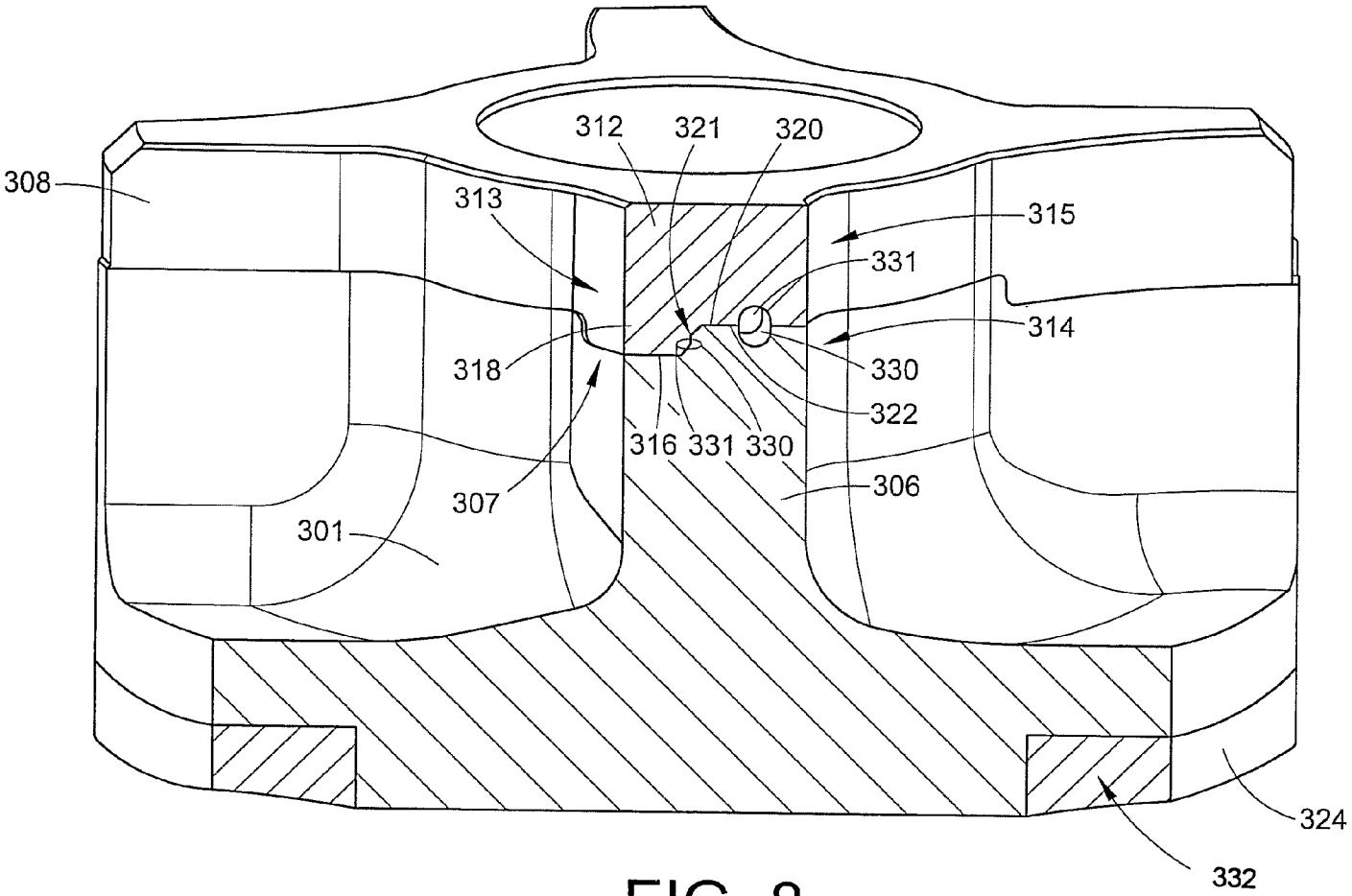
FIG. 8 is a cross section view of vane of the impeller of FIG. 7.

Referring now to FIGS. 7-9, an alternative impeller embodiment is depicted. Particularly, impeller 300 is comprised of a main body 301 having a substantially cylindrical base 302 from which a hub 304 extends. A plurality of vanes 306 extend from the base 302 and the hub 304. Hub 304 is provided to receive a shaft connected to a motor to provide rotation of the impeller 300. Impeller 300 has an intended direction of rotation depicted by arrow 305. Impeller base 301 can further include a groove 332 formed to receive a bearing ring 324.

The impeller 300 further comprises a cap member 308 which overlays the main body 301. Cap member 308 can be secured to the main body 301 by cement or other adhesive joinder. Cement in cooperating grooves 330 and 331 can form a cement channel extending in body 301 and cap member 308.

Cap member 308 includes a ring 310 which overlays hub 304 and fingers 312 which overlay vanes 306. Each vane/finger 306/312 has a leading edge 307/313 and a trailing edge 314/315. The leading edge 307 of vane 306 is provided with a recess 316 receiving a projection 318 on the leading edge 313 of finger 312. The trailing edge 315 of finger 312 is provided with a recess 320 receiving a projection 322 on the trailing edge 314 of vane 306.

In certain embodiments, the transition between recess and projection can be formed at substantially a right angle such that a vertical interface 321 exists between the cap member 308 and the main body 301. The interface 321 can provide an effective energy transfer plane between the cap member 308 and the main body 301 to improve energy transfer between the cap member and the larger mass of the impeller body resulting from the impact of particulate in a molten metal environment. A groove 330/331 may be formed in the vane 306 and finger 312, respectively, in the vicinity of the interface 321, which receives cement and improves the joinder of the components.

According to certain embodiments, the cap member can be formed of a higher density material than the impeller body. For example, the cap member can be formed of a ceramic and the impeller body formed of a graphite.

The cooperative recesses and projections of the fingers and the vanes can extend any suitable length, although the greater the extension along the vertical interface, the more advantageous the design may become. Accordingly, the recesses/projections can extend the full length of the vanes/fingers. Furthermore, it is noted that although described in association with a cylindrical impeller body typically utilized in a pumping chamber, it is also contemplated that the described cap impeller mating arrangement can be used with non-cylindrical designs utilized in degassing, submergence and pump environments wherein a traditional base is not employed.

The present design has been found particularly effective in high rock inclusive molten metal environments. Particularly, the high strength cap member has been found to provide increased strength. In general, in each embodiment, the cap member can be comprised of a fine grain refractory material, such as silicon carbide. Preferably, the material has a suitable coefficient of thermal match to graphite, for example, no more than a three to one difference. In this regard, SiC having a $2.2\times10^{-6}$ in/in/° F. and graphite having a $7\times10^{-7}$ in/in/° F. are sufficiently compatible. Furthermore, it is noted that the grain size of the fine grain refractory is preferably not too fine (for example larger than 3 microns may be desirable; although if a mixture of particle sizes is employed it is feasible even smaller sized particles could be present provided larger sized particles are also present such that for example an average particle size layer greater than 3 micros is achieved) to allow cement to suitably grip the material.

In addition, it is noted that although much of the present disclosure has focused on the use of a ceramic cap member to provide the improved flow in combination with protection of the graphite body, the disclosure also contemplates an impeller without the ceramic cap. Moreover, the improved flow design can be machined directly into the surface of the graphite body of the impeller. For environments that have little or no entrained particles, the requirement for a cap is diminished, yet the desire to retain the improved flow of the present inlet shaping remains.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A molten metal impeller comprised of a generally cylindrical body including a plurality of passages extending from a top surface to a side wall and a cap member secured to a top surface of the body, the body comprising a cylindrical base including a centrally disposed hub and a plurality of vanes disposed on the base and extending form the hub, the cap member including a ring forming a central passage shaped to cooperatively overlay the hub and a plurality of fingers extending radially from the ring and shaped to cooperatively overlay the vanes, the top surface having an at least substantially planar major portion defining the hub and extending to a radial end of the vane, said major surface disposed adjacent a trailing edge of the vane, the cap member including a first side seated on the top surface and a second opposed side, the top surface including recess forming a minor portion of the top surface adjacent a leading edge of the vane and the first side of the cap member including a protrusion oriented to cooperatively mate with the recess.

2. The impeller of claim 1 wherein each finger includes a protrusion oriented to mate with a recess in the top surface of the body.

3. The impeller of claim 1 wherein the body is comprised of graphite.

4. The impeller of claim 1 wherein the cap member is comprised of ceramic.

5. The impeller of claim 1 wherein the mated recesses and protrusions extend radially from an interior of the impeller toward a periphery of the impeller.

6. The impeller of claim 5 wherein the mated recesses and protrusions extend radially on the vanes and fingers from adjacent the hub and ring respectively to adjacent the periphery of the impeller.

7. The impeller of claim 1 including a bearing ring.

8. A molten metal pump comprised of a motor, and an associated shaft, the shaft including the impeller of claim 1 disposed at one end.

9. The molten metal pump of claim 8 further comprising a base defining a pumping chamber in which the impeller is disposed and at least one post connecting the base and a motor mount supporting the motor.

10. An impeller having an intended direction of rotation comprised of a body having an at least substantially cylindrical base, a hub disposed on a first side of the base and a plurality of vanes extending from the base and the hub, the vanes including a free end adjacent a periphery of the impeller and a cap receiving side opposed to a side extending from the base, the cap receiving side having a receiving surface including a recessed leading edge in the intended direction of rotation and a raised trailing edge, a cap member having a ring sized to overlay the hub and a plurality of fingers extending from the ring and configured to overlay the vanes, at least one finger including a surface having a projection mating with the recessed leading edge of the associated vane and a recessed trailing edge mating with the raised trailing edge of the associated vane, and a cement filled groove disposed on said receiving surface at an interface of the recessed leading edge and raised trailing edge.

11. The impeller of claim 10 wherein the cap member is comprised of a higher density material than the body.

12. The impeller of claim 10 wherein said interface further includes a chamfer.

13. An impeller having an intended direction of rotation comprised of a graphite body having a base and a plurality of vanes extending from the base and a hub, the vanes include a ceramic cap receiving side opposed to the base, the cap receiving side includes a cap receiving surface having a recessed leading edge and a raised trailing edge in the intended direction of rotation, said raised trailing edge having a greater width than said recessed leading edge, a cap having a plurality of fingers configured to overlay the vanes is mounted to the body, at least one finger includes a surface having a projection mating with the recessed leading edge of the associated receiving surface, and a recessed trailing edge mating with a projection on the trailing edge of the associated receiving surface.

14. The impeller of claim 13 wherein each finger includes a projection and a recessed trailing edge.

15. The impeller of claim 13 wherein said projection and said recessed trailing edge extend substantially the length of the finger.

16. The impeller of claim 13 wherein said finger projection abuts the raised trailing edge of the vane to form an interface.

17. The impeller of claim 16 wherein said interface is oriented substantially transverse to a plane in which said intended direction of rotation resides.

18. The impeller of claim 17 wherein said interface includes a groove.

* * * * *